US007856677B1

(12) United States Patent
Harris

(10) Patent No.: US 7,856,677 B1
(45) Date of Patent: Dec. 28, 2010

(54) COVER FOR A BATHTUB OVERFLOW PORT AND ASSOCIATED METHOD

(76) Inventor: Brian Harris, 1738 E. Avenue R 12, Palmdale, CA (US) 93550

( * ) Notice: Subject to any disclaimer, the term of this patent is extended or adjusted under 35 U.S.C. 154(b) by 794 days.

(21) Appl. No.: 11/827,472

(22) Filed: Jul. 13, 2007

(51) Int. Cl.
*A47K 1/14* (2006.01)

(52) U.S. Cl. ..... 4/295; 4/694; 4/680

(58) Field of Classification Search ..... 4/295, 4/694, 680, 255.05, 255.07, 255.11
See application file for complete search history.

(56) References Cited

U.S. PATENT DOCUMENTS

| | | | | |
|---|---|---|---|---|
| 656,352 | A * | 8/1900 | Holmes | 4/293 |
| 1,187,221 | A * | 6/1916 | Youdelman | 4/295 |
| 1,598,162 | A | 8/1926 | Solomon | |
| 1,613,251 | A * | 1/1927 | Stead | 4/295 |
| 1,704,023 | A * | 3/1929 | Stead | 4/295 |
| 1,931,086 | A * | 10/1933 | Schwarz et al. | 4/295 |
| 4,135,260 | A * | 1/1979 | Gresh | 4/680 |
| 5,025,209 | A | 6/1991 | Takanashi et al. | |
| 5,228,153 | A * | 7/1993 | Frankel | 4/694 |
| 6,216,288 | B1 | 4/2001 | Bernau | |
| 6,732,385 | B1 * | 5/2004 | Henderson et al. | 4/295 |
| 6,915,533 | B1 * | 7/2005 | Gorobets | 4/255.11 |
| 7,237,280 | B1 * | 7/2007 | Holden et al. | 4/680 |
| 7,367,078 | B2 * | 5/2008 | Mameletzi et al. | 4/295 |
| 2004/0118838 | A1 * | 6/2004 | Park | 219/725 |

* cited by examiner

*Primary Examiner*—Khoa D Huynh

(57) ABSTRACT

A cover for a bathtub overflow port includes a concave body provided with a circular inner edge maintaining a vacuum seal with an inner surface of the existing bathtub. Such a circular inner edge of the body is removably abutted directly against the inner surface of the existing bathtub during operating conditions. The inner edge of the body creates a vacuum within the body when the inner edge of the body is abutted against the inner surface of the existing bathtub. Such a vacuum statically affixes the body to the inner surface of the existing bathtub during operating conditions. The cover further includes a curvilinear handle provided with axially opposed ends.

1 Claim, 7 Drawing Sheets

COVER FOR A BATHTUB OVERFLOW PORT AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to suction covers and, more particularly, to a cover for a bathtub overflow port for assisting a user to fill an existing bathtub with water above the bathtub overflow port.

2. Prior Art

Bathing can be one of the most enjoyable and invigorating activities of the day. Providing an eye-opening renewal, taking a shower upon waking is a preferred method of greeting the morning. Allowing the cool, pulsating spray of the water to cascade over the face and to gently massage the neck, shoulders and back can be a delightful energizer even for the groggiest people. Conversely, many more may favor a luxurious bath at the end of hectic and busy days. Soaking in a bathtub full of warm, scented water and surrounded by fragrant caressing bubbles can provide a much needed respite for the mind, body, and spirit. Adding to the relaxing ambiance, some may sprinkle cleansing and soothing bath salts into the water and encircle the perimeter of the tub with aromatic, flickering candles. Settling in to soak away the cares and worries of the day, those who enjoy a long hot bath often find this the perfect time to lose themselves in a favorite magazine or the latest best-selling novel, listen to soft musical sounds coming from a stereo, or even enjoy a glass of wine. Free from the distractions of a busy household, engaging in these activities while bathing allows many to be entertained while they relax.

Both men and women relish the opportunity to luxuriate in a full, fragrant bath. However, this enjoyment can sometimes be short-lived. For those who enjoy completely immersing themselves in a full tub of water, such an endeavor is often impeded by the tub's overflow port. A small opening near the top of the bathtub that drains excess water to keep the bath from running over the sides, this practical component can actually lead to frustration. Particularly, in order to keep the water level over their shoulders, consumers must continuously top off the bath by running more water. Not only does this annoying task constantly interrupt a relaxing bath, but repeatedly adding even more water can become wasteful and even costly.

U.S. Pat. No. 6,216,288 to Bernan discloses a sealing member for a bathtub. A conventional plate is coupled to the wall of a bathtub and covers a drain opening formed therein. The plate is continuous except for an overflow opening which accommodates the free flow of water from the bathtub through the drain opening and down the overflow drain of the bathtub. The sealing member sealingly engages the plate and the bathtub wall to prevent water from flowing through the overflow opening of the plate and down the overflow drain of the bathtub. The sealing member includes an annular lip which fits snugly within the overflow opening of the plate. In an alternate embodiment, a bypass opening is formed in the sealing member at a height greater than that of the overflow opening of the plate. A channel formed within the sealing member extends between the bypass opening and the overflow drain. Water may then enter the sealing member at a height greater than the overflow opening and be channeled through the overflow drain and out of the bathtub. Unfortunately, this prior art example is not designed for temporary use, and must U.S. Pat. No. 5,330,811 to Buchalter discloses a laminate cover member for upgrading the appearance of a deteriorated drain hole or other surface of a sink or bath fixture. The cover member includes an upper layer which is resistant to corrosion and has an attractive visual appearance, a pressure sensitive adhesive layer, and a removable liner layer. The layers are diecut from stock laminate sheets. A preferred cover member, for upgrading the surfaces of a drain hole, has a metallized plastic upper layer, and is shaped with an outer annular portion that is adhered to the surface surrounding the drain hole, an inner annular hole, and a plurality of radial lines extending from an intermediate diameter to the inner annular hole, such that they can be bent downwardly to cover an inner part of the drain hole surface. Unfortunately, this prior art example is not designed for preventing draining of a bathtub via the overflow port.

U.S. Pat. No. 5,025,509 to Holt discloses an overflow level controller for a bathtub. The overflow level controller includes an adapter ring to facilitate connection with a conventional bathtub fixture base, and further includes housing with a removable covering. Rotation of the housing adjusts the overflow level of the bathtub. Unfortunately, this prior art example is not designed to completely prevent the draining of water from a bathtub via the overflow port.

Accordingly, the present invention is disclosed in order to overcome the above noted shortcomings. The present invention is convenient and easy to use, lightweight yet durable in design, and designed for assisting a user to fill an existing bathtub with water above the bathtub overflow port. The apparatus is designed to completely cover a bathtub's overflow port and is installed or removed within a matter of seconds. The apparatus prevents the need for adding more water to a bathtub while a user is bathing, and thereby the apparatus may save many gallons of water a year. The present invention is simple to use, inexpensive, and designed for many years of repeated use.

BRIEF SUMMARY OF THE INVENTION

In view of the foregoing background, it is therefore an object of the present invention to provide a means for assisting a user to fill an existing bathtub with water above the bathtub overflow port. These and other objects, features, and advantages of the invention are provided by a cover for a bathtub overflow port.

A cover for a bathtub overflow port includes a concave body provided with a circular inner edge maintaining a vacuum seal with an inner surface of the existing bathtub. Such a circular inner edge of the body is removably abutted directly against an inner surface of the existing bathtub during operating conditions. The inner edge of the body effectively creates a vacuum within the body when the inner edge of the body is abutted against the inner surface of the existing bathtub. Such a vacuum statically affixes the body to the inner surface of the existing bathtub during operating conditions.

The body is suitably sized such that the body completely covers an existing overflow port of the existing bathtub thereby prohibiting water from prematurely and undesirably escaping from the existing bathtub via the existing overflow port.

The cover further includes a curvilinear handle provided with axially opposed ends. Such ends of the handle are monolithically formed with an outer surface of the body, and the ends of the handle are spaced from each other along the outer surface of the body and further are spaced from the inner edge of the body. The ends of the handle are further conveniently located above a centrally registered line that bisects the body into equally sized upper and lower halves respectively. The handle has a longitudinal length registered parallel to the centrally registered line of the body. The handle advantageously has a closed end extending outwardly and away from the outer surface of the body such that the user can grasp the closed end of the handle with a selected user hand and remove the body from the inner surface of the existing bathtub as desired. The body and the handle respectively are formed from pliant and waterproof material.

A method for assisting a user to fill an existing bathtub with water above the bathtub overflow port by employing an overflow port cover includes the steps of: providing a concave body provided with a circular inner edge; and providing a curvilinear handle with axially opposed ends. Such ends of the handle are monolithically formed with an outer surface of the body, and the body and the handle respectively are formed from pliant and waterproof material.

The method further includes the steps of: abutting the inner edge of the body directly against an inner surface of the existing bathtub; applying pressure to the outer surface of the body with the selected user hand such that the outer surface of the body is deformed toward the inner surface of the existing bathtub; and decreasing the pressure and removing the selected user hand respectively from the outer surface of the body.

The method further includes the steps of: creating a vacuum within the body when the inner edge of the body is abutted against the inner surface of the existing bathtub and the pressure is applied to the outer surface thereof; and affixing the body to the inner surface of the existing bathtub via the vacuum during operating conditions.

The method further includes the steps of covering an existing overflow port of the existing bathtub with the body and thereby prohibiting water from prematurely and undesirably escaping from the existing bathtub via the existing overflow port. Such a body is suitably sized such that the body completely covers the existing overflow port of the existing bathtub.

The method further includes the steps of grasping a closed end of the handle with the selected user hand. Such a closed end of the handle extends outwardly and away from the outer surface of the body. The steps further include: applying an outward pressure to the outer surface of the body via the handle; removing the body from the inner surface of the existing bathtub; and allowing water contained within the existing bathtub to escape the existing bathtub via the existing overflow port.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
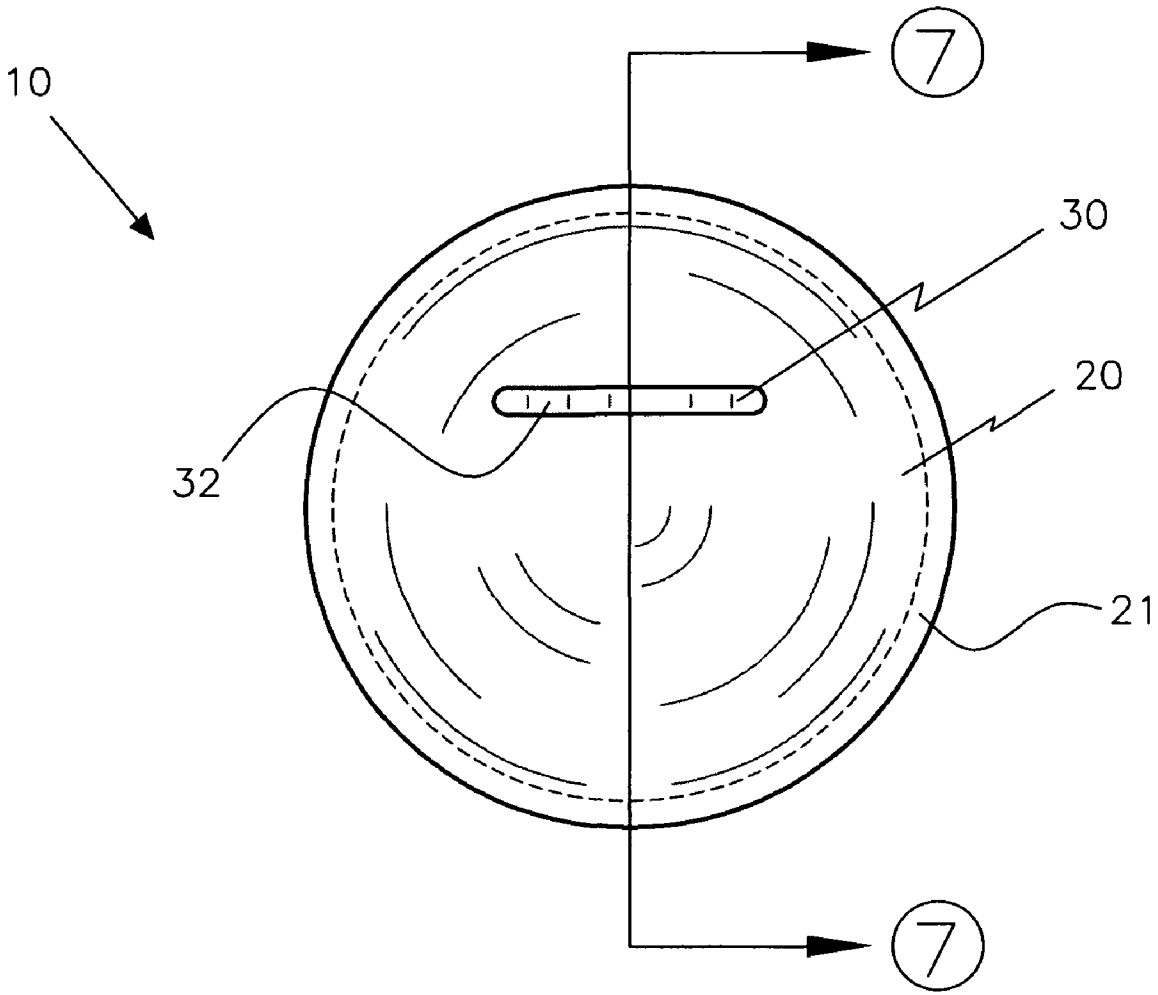
FIG. 1 is a front elevational view of a cover for a bathtub overflow port, in accordance with the present invention.
Figure 2:
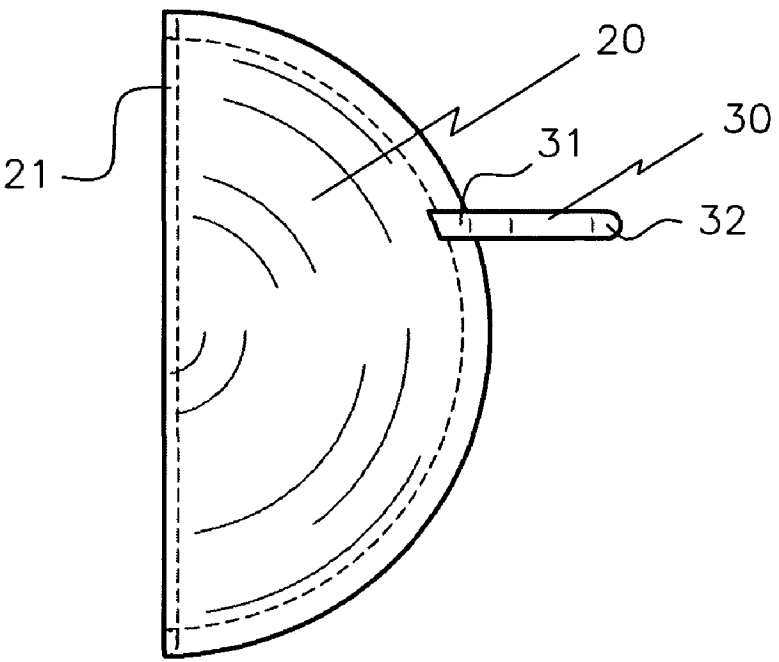
FIG. 2 is a side elevational view of a cover for a bathtub overflow port, in accordance with the present invention.
Figure 3:
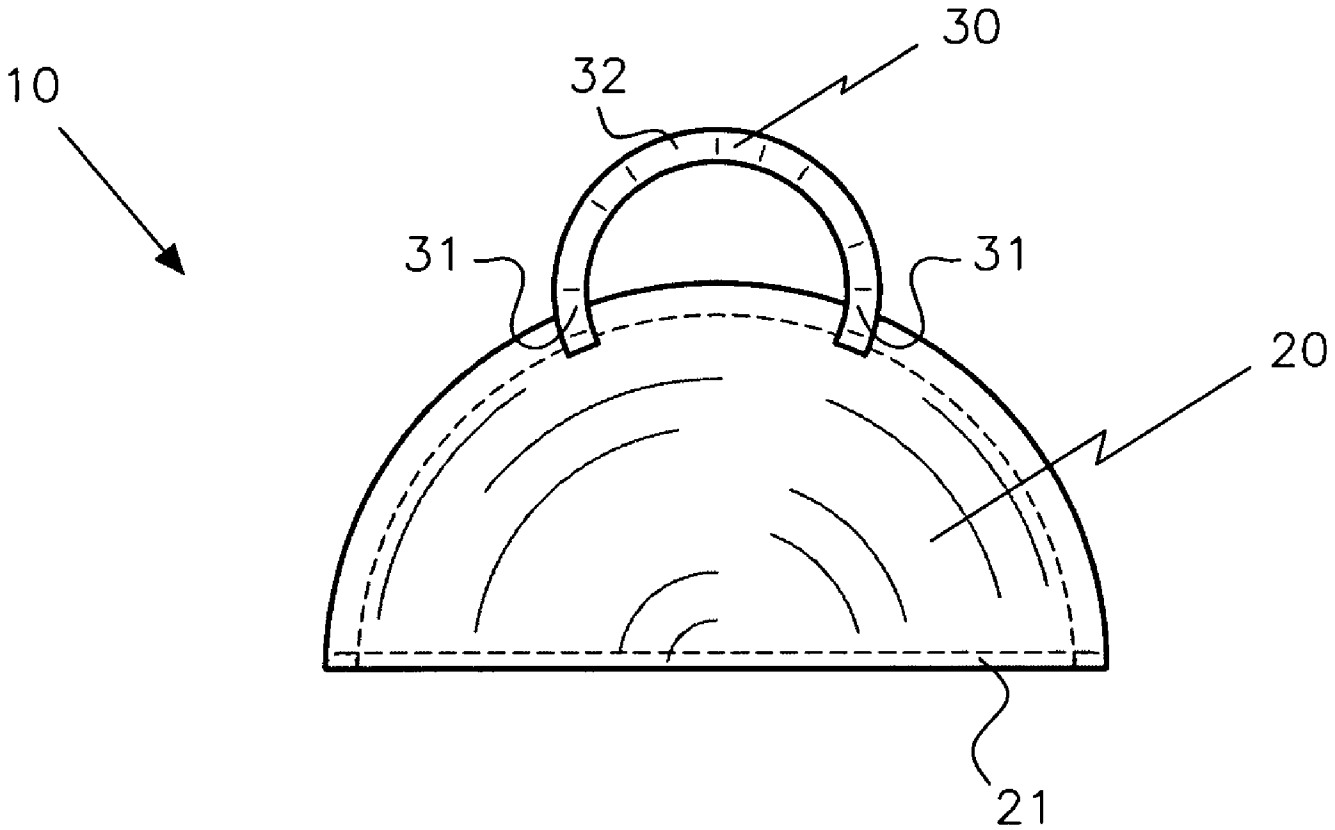
FIG. 3 is a top planar view of a cover for a bathtub overflow port, in accordance with the present invention.
Figure 4:
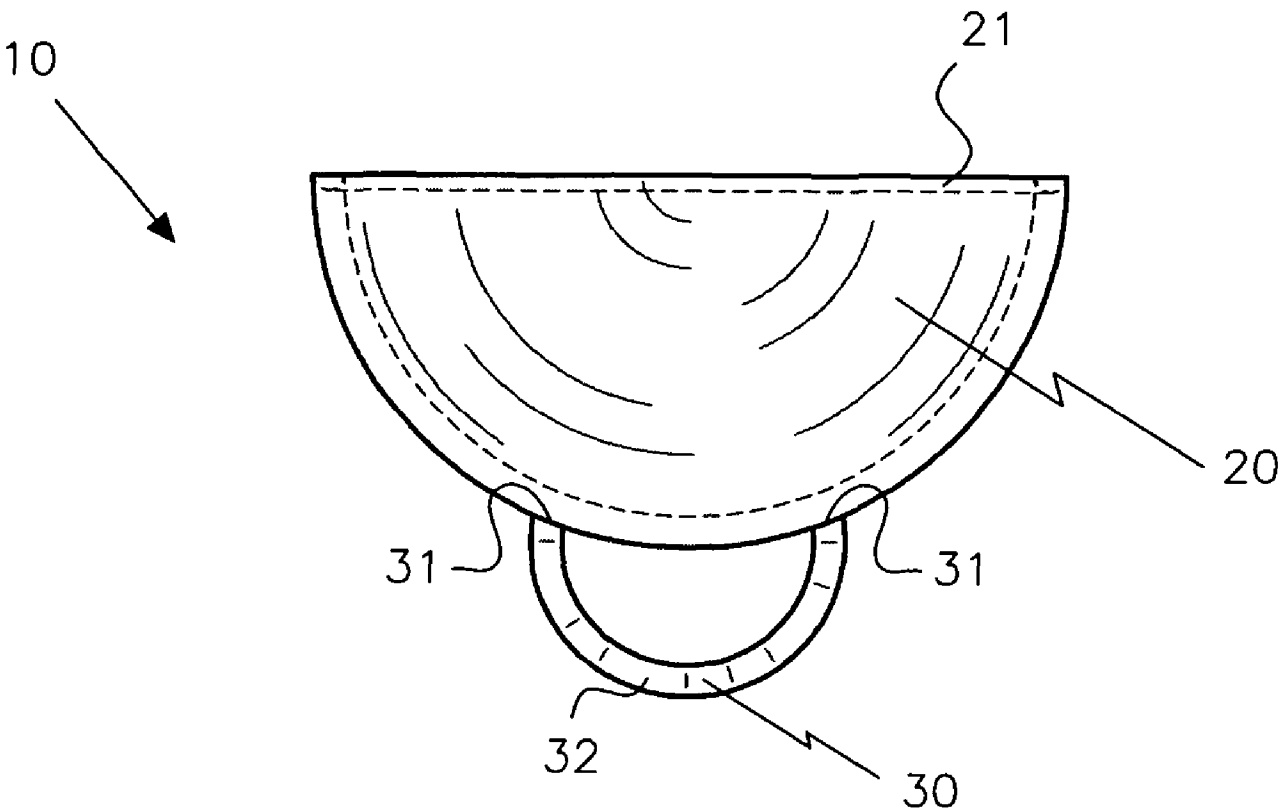
FIG. 4 is a bottom planar view of a cover for a bathtub overflow port, in accordance with the present invention.
Figure 5:
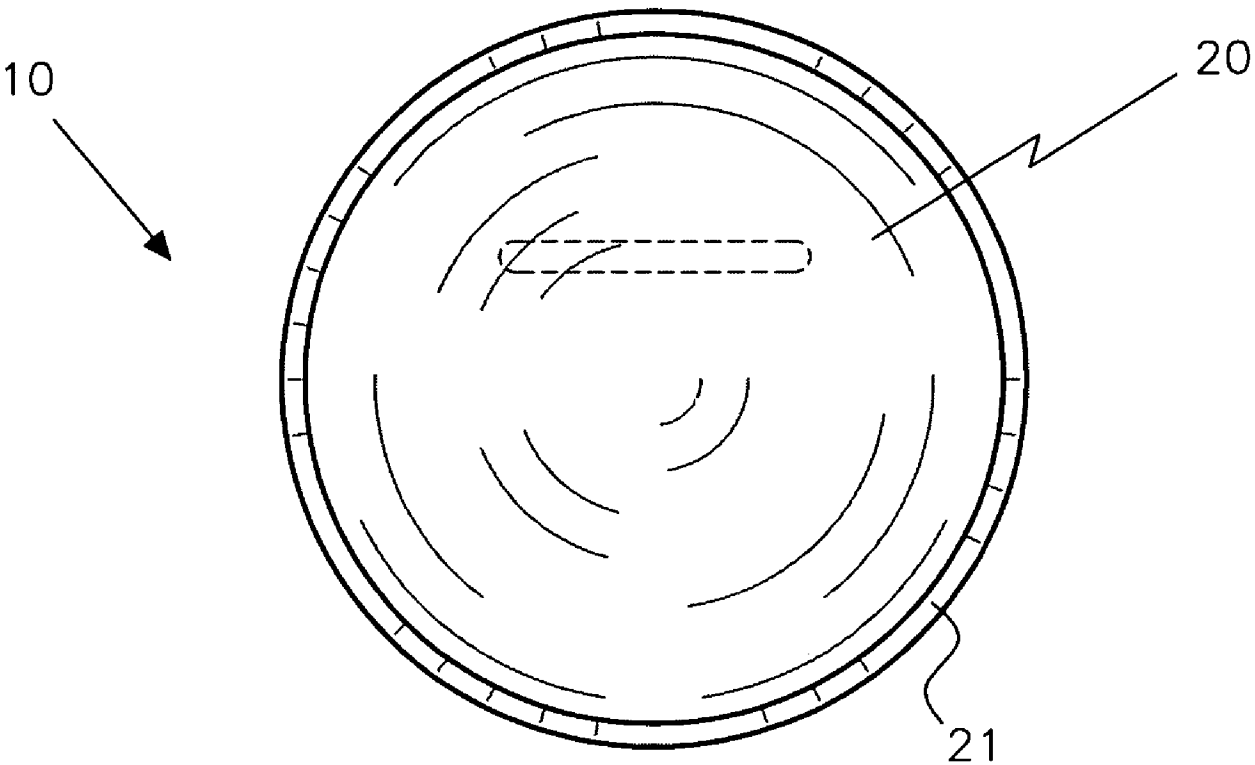
FIG. 5 is a rear elevational view of a cover for a bathtub overflow port, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7 by the reference numeral 10 and is intended to provide a means for assisting a user to fill an existing bathtub with water above the bathtub overflow port. It should be understood that the apparatus 10 may be used to cover many different types of drain holes and should not be limited in use to covering only those types of drain holes mentioned herein.

Figure 6:
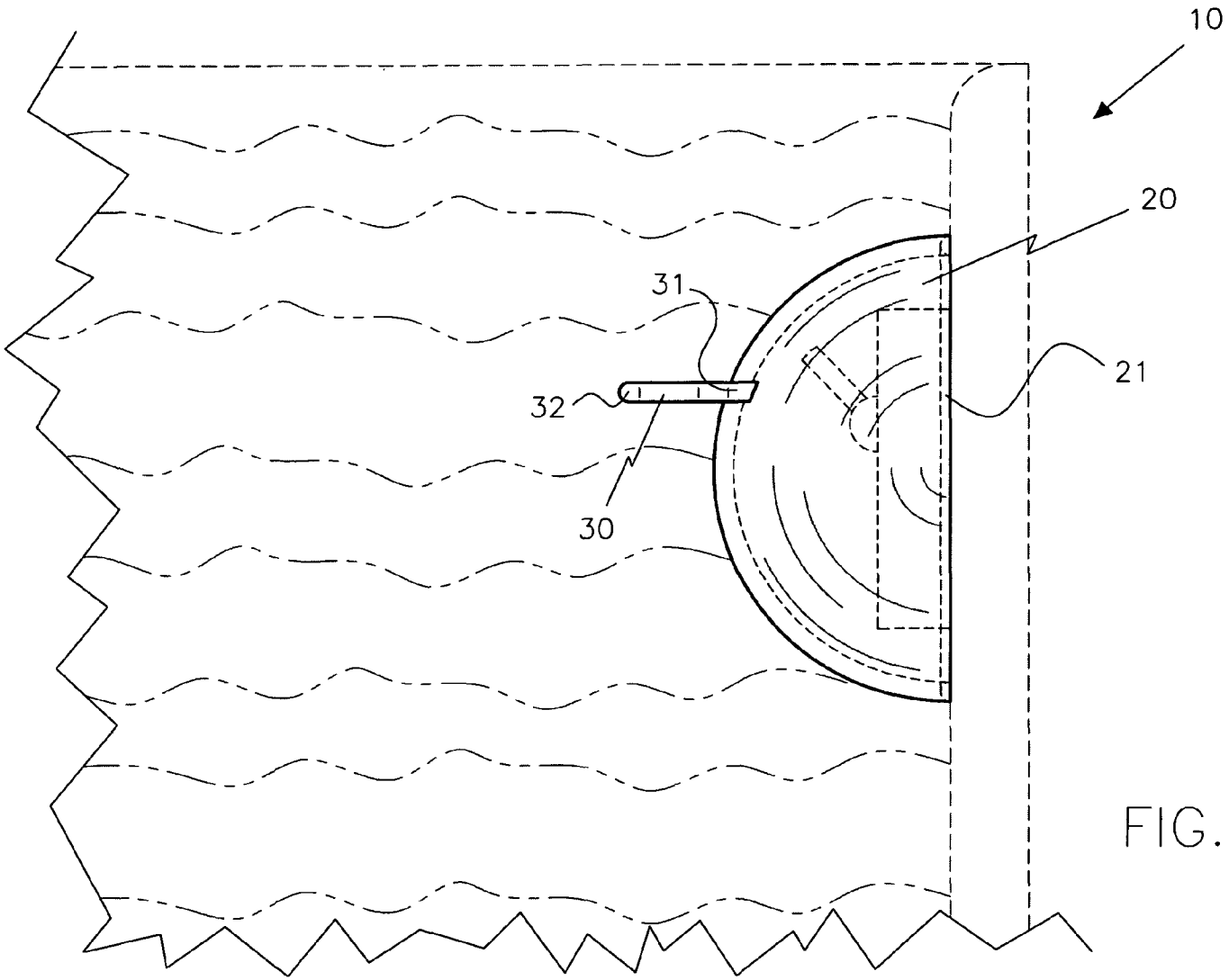
FIG. 6 is a side elevational view of a cover for a bathtub overflow port attached to the interior wall of a bathtub, in accordance with the present invention.
Figure 7:
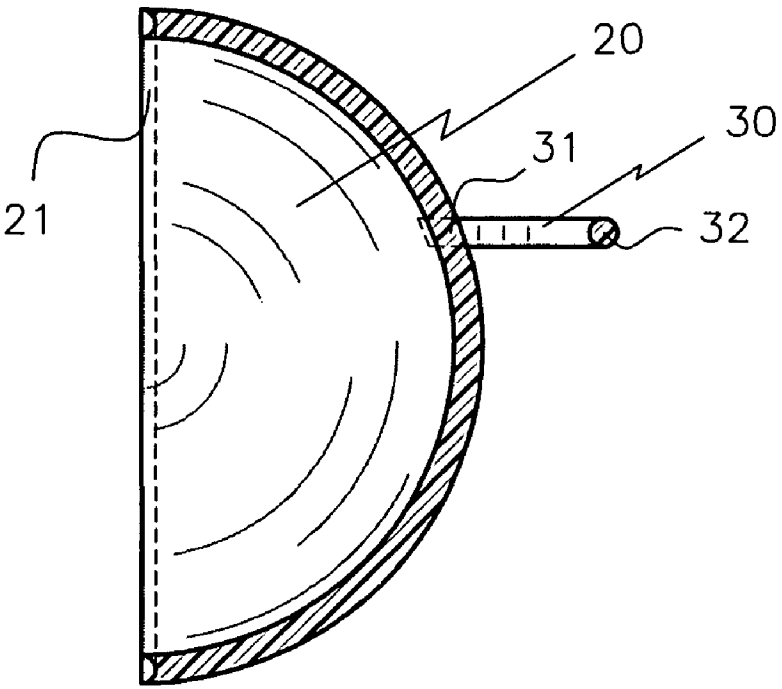
FIG. 7 is a cross sectional view showing a cover for a bathtub overflow port, in accordance with the present invention.

Referring to FIGS. 1, 2, 3, 4, 5, 6 and 7, a cover for a bathtub overflow port includes a concave body 20 provided with a circular inner edge 21 maintaining a vacuum seal with an inner surface of the existing bathtub. Such a circular inner edge 21 of the body is removably abutted directly against the inner surface of the existing bathtub, without the use of intervening characters, during operating conditions. The inner edge 21 of the body 20 creates a vacuum within the body when the inner edge of the body is abutted against the inner surface of the existing bathtub. Such a vacuum statically affixes the body to the inner surface of the existing bathtub during operating conditions. The body 20 is suitably sized which is essential such that the body 20 completely covers an existing overflow port of the existing bathtub thereby prohibiting water from prematurely and undesirably escaping from the existing bathtub via the existing overflow port (FIG. 6 illustrates the bathtub or existing overflow port having a port formed on the inner surface of one of the sidewalls of the bathtub and an overflow cap covering the port). The concave body provides a means for fully covering the overflow, thereby preventing any water from draining out of the bathtub.

Referring again to FIGS. 1, 2, 3, 4, 5, 6 and 7, the cover further includes a curvilinear handle 30 provided with axially opposed ends 31. Such ends 31 of the handle are monolithically formed with an outer surface of the body 20, and the ends of the handle 31 are spaced from each other along the outer surface of the body and further are spaced from the inner edge of the body. The ends of the handle are further located above a centrally registered line that bisects the body into equally sized upper and lower halves respectively. The handle 30 has a longitudinal length registered parallel to the centrally registered line of the body.

The handle 30 has a closed end 32 extending outwardly and away from the outer surface of the body 20 which is important such that the user can grasp the closed end 32 of the handle with a selected user hand and remove the body 20 from the inner surface of the existing bathtub as desired. The body and the handle respectively are formed from pliant and waterproof material. The handle provides a means for easily grasping the body of the apparatus for easy removal.

The body 20 provides the unexpected benefit of allowing a user to easily cover entirely the port and the overflow cap of the bathtub overflow port (FIG. 6) by vacuum sealing the circular inner edge 21 of the body 20 with the inner surface of the bathtub while a remaining portion of the body 20 is not vacuum sealed. As illustrated in FIG. 6, the circular inner edge of the bathtub overflow port cover continuously extends along a 360 degree path. In addition, the handle provides for easy grasping of the slippery body in order to facilitate removal of the apparatus from the overflow drain. Such benefits overcome the prior art shortcomings.

In use, a method for assisting a user to fill an existing bathtub with water above the bathtub overflow port by employing an overflow port cover includes the steps of: providing a concave body 20 provided with a circular inner edge 21; and providing a curvilinear handle 30 with axially opposed ends 31. Such ends 31 of the handle are monolithically formed with an outer surface of the body 20 and the body and the handle respectively are formed from pliant and waterproof material.

In use, the method further includes the steps of: abutting the inner edge 21 of the body directly against an inner surface of the existing bathtub; applying pressure to the outer surface of the body 20 with the selected user hand such that the outer surface of the body is deformed toward the inner surface of the existing bathtub; and decreasing the pressure and removing the selected user hand respectively from the outer surface of the body.

In use, the method further includes the steps of: creating a vacuum within the body 20 when the inner edge of the body is abutted against the inner surface of the existing bathtub and the pressure is applied to the outer surface thereof; and affixing the body to the inner surface of the existing bathtub via the vacuum during operating conditions. The method further includes the steps of covering an existing overflow port of the existing bathtub with the body and thereby prohibiting water from prematurely and undesirably escaping from the existing bathtub via the existing overflow port. Such a body is suitably sized such that the body completely covers the existing overflow port of the existing bathtub.

In use, the method further includes the steps of grasping a closed end 32 of the handle 30 with the selected user hand. Such a closed end 32 of the handle extends outwardly and away from the outer surface of the body 20. The steps further include: applying an outward pressure to the outer surface of the body via the handle 30; removing the body from the inner surface of the existing bathtub; and allowing water contained within the existing bathtub to escape the existing bathtub via the existing overflow port.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A bathtub overflow port cover in combination with a conventional bathtub, the combination comprising:

the conventional bathtub having sidewalls which extend upwardly from a floor to define a chamber for holding bathing water to be filled by a user, the bathtub further comprises a bathtub overflow port to allow water to overflow into a bathtub drain, said bathtub overflow port having a port formed on an inner surface of one of the sidewalls of the bathtub and an overflow cap selectively covering the port; and a dome-shaped bathtub overflow port cover removably positioned over the bathtub overflow port, the bathtub overflow port cover comprising:

a concave body provided with a circular inner edge, and a curvilinear handle provided with axially opposed ends, the opposed ends of the curvilinear handle being monolithically formed with an outer surface of the concave body;

wherein the concave body and the curvilinear handle are formed from pliant and waterproof material respectively;

wherein the circular inner edge maintains a vacuum seal with the inner surface of the conventional bathtub and remains positioned about the bathtub overflow port;

wherein the circular inner edge of the bathtub overflow port cover continuously extends along a 360 degree path;

wherein an entire circumferential length of the circular inner edge is equidistantly spaced from a center of the concave body while attached to the inner surface of the conventional bathtub;

wherein the circular inner edge of the concave body creates a vacuum within the concave body when the circular inner edge of the concave body is abutted directly against the inner surface of the bathtub, the vacuum statically affixing the concave body to the inner surface of the bathtub;

wherein the concave body is suitably sized such that the concave body completely covers the port and the overflow cap of the bathtub overflow port thereby prohibiting water from prematurely and undesirably escaping from the bathtub via the bathtub overflow port;

wherein the opposed ends of the curvilinear handle are spaced from each other along the outer surface of the concave body and further are spaced from the circular inner edge of the concave body, the opposed ends of the curvilinear handle being located above a centrally registered line that bisects the concave body into equally sized upper and lower halves respectively, the curvilinear handle having a longitudinal length registered parallel to the centrally registered line of the concave body;

wherein the curvilinear handle has a closed end extending outwardly and away from the outer surface of the concave body for allowing the user to grasp the closed end of the curvilinear handle and thereby remove the concave body from the inner surface of the bathtub.

* * * * *